US005509477A

United States Patent [19]

Ryan

[11] Patent Number: 5,509,477

[45] Date of Patent: Apr. 23, 1996

[54] BOREHOLE VENTILATION SEALCOVER

[75] Inventor: Dino Ryan, Marathon, Canada

[73] Assignee: Victor Marcinkowski, Sault Ste Marie, Canada; a part interest

[21] Appl. No.: 429,555

[22] Filed: Apr. 27, 1995

[51] Int. Cl.[6] ..... E21B 33/02

[52] U.S. Cl. ..... 166/76.1; 166/79.1; 166/82.1; 166/84.5; 405/135

[58] Field of Search ..... 166/75.11, 76.1, 166/79.1, 82.1, 84.5; 405/135

[56] References Cited

U.S. PATENT DOCUMENTS

| | | | |
|---|---|---|---|
| 1,467,877 | 9/1923 | Rea | 166/84.5 |
| 1,557,915 | 10/1925 | York | 166/84.5 X |
| 1,762,211 | 6/1930 | Bradford | 166/82.1 |
| 2,255,829 | 9/1941 | Spang et al. | 166/82.1 X |
| 2,306,617 | 12/1942 | Dick | 166/82.1 |
| 2,990,166 | 6/1961 | Walsh . | |
| 4,008,576 | 2/1977 | Meyer et al. | 299/12 X |
| 4,072,015 | 2/1978 | Morrell et al. | 299/11 X |
| 4,716,962 | 1/1988 | Rundell | 166/82.1 X |
| 4,813,358 | 3/1989 | Roberts | 102/313 |
| 4,900,607 | 2/1990 | Glang et al. | 405/135 X |

*Primary Examiner*—Roger J. Schoeppel
*Attorney, Agent, or Firm*—Richard J. Hicks

[57] ABSTRACT

A simple bore hole plug for either temporarily or permanently sealing mine bore holes and ventilating shafts or the like is described. A plurality of used motor vehicle tires are arranged one upon the other coaxially in increasing order of diameter. Steel plates are placed at the top and bottom of the tire pile and maintained in spaced relation by means of a metal separator pipe. A steel rod having a lifting eye at one end and a threaded portion at the other end, is passed axially through the pipe and a nut is tightened on the threaded portion to draw the tires tightly together.

7 Claims, 2 Drawing Sheets

BOREHOLE VENTILATION SEALCOVER

FIELD OF INVENTION

This invention relates to a plug for sealing boreholes and the like and more particularly to a borehole plug for use in ventilating shafts in underground mines.

BACKGROUND OF INVENTION

In stope mining drilling is carried out at an upper level while mucking, or removal of the mined rock, is carried out at a lower level in the mine. These levels are connected by raised bores down which mined ore or backfill are passed as appropriate. There are periods of time, therefore, when both he stope cap and mucking brow are open which provides an alternate by-pass route for ventilation air which could be better used in the main drifts of the mine. In some cases reverse air flows can occur. It is, therefore, prudent practise to limit the period of time the brow is left open and also to provide ventilation curtains in the appropriate stops access. Ventilation curtains are, however, very expensive to build and maintain and in any event they frequently lock and cannot withstand the shock wave created by underground blasting operations. Many attempts to circumvent the problems encountered with ventilation curtains have been made with only limited success. Such attempts include foam barriers, which do not stand up to the rigours of underground mining operations; flat steel raise-bore covers which can be covered with loose muck to hold them in place but which are only satisfactory as permanent installations, require smooth surfaces to make an adequate seal and which are susceptible to movement due to concussion shock; and inflatable balloon plugs rather like a navigational or mooring buoy which can be inflated to about 54" diameter to seal against the walls of a circular hole. Balloon plugs are effective as if they are moved by blast they settle back into place, but they suffer from the disadvantage that they do not prevent inadvertent access to the raise nor do they safely cover a fill hole and thus require additional barricading. There is, therefore a considerable need for an inexpensive raise bore cover which can be used independently of ventilation curtains or the like, which can be quickly and easily installed and equally quickly be removed or which can be permanently sealed into place.

OBJECT OF INVENTION

Thus it is an object of the present invention to provide a simple, effective bore hole raise plug which can be used either as a permanent plug or as a removable plug without resorting to ventilation curtains and the like.

It is a further object of the invention to provide a bore hole plug which uses recycled waste materials and in particular scrap automobile and truck tires,

STATEMENT OF INVENTION

Thus, by one aspect of this invention there is provided a bore hole cover comprising: a plurality of hollow ring members of selected diameters having substantially parallel opposed sides arranged in overlying planar coaxial relationship in order of increasing diameter;

a pair of substantially rigid disc members arranged in planar spaced coaxial relationship or respective opposite sides of said coaxially arranged ring members;

a tubular spacer member mounted coaxially between said disc members and;

rod means coaxially arranged in said tubular spacer member.

DETAILED DESCRIPTION OF PREFERRED EMBODIMENTS

Figure 1:
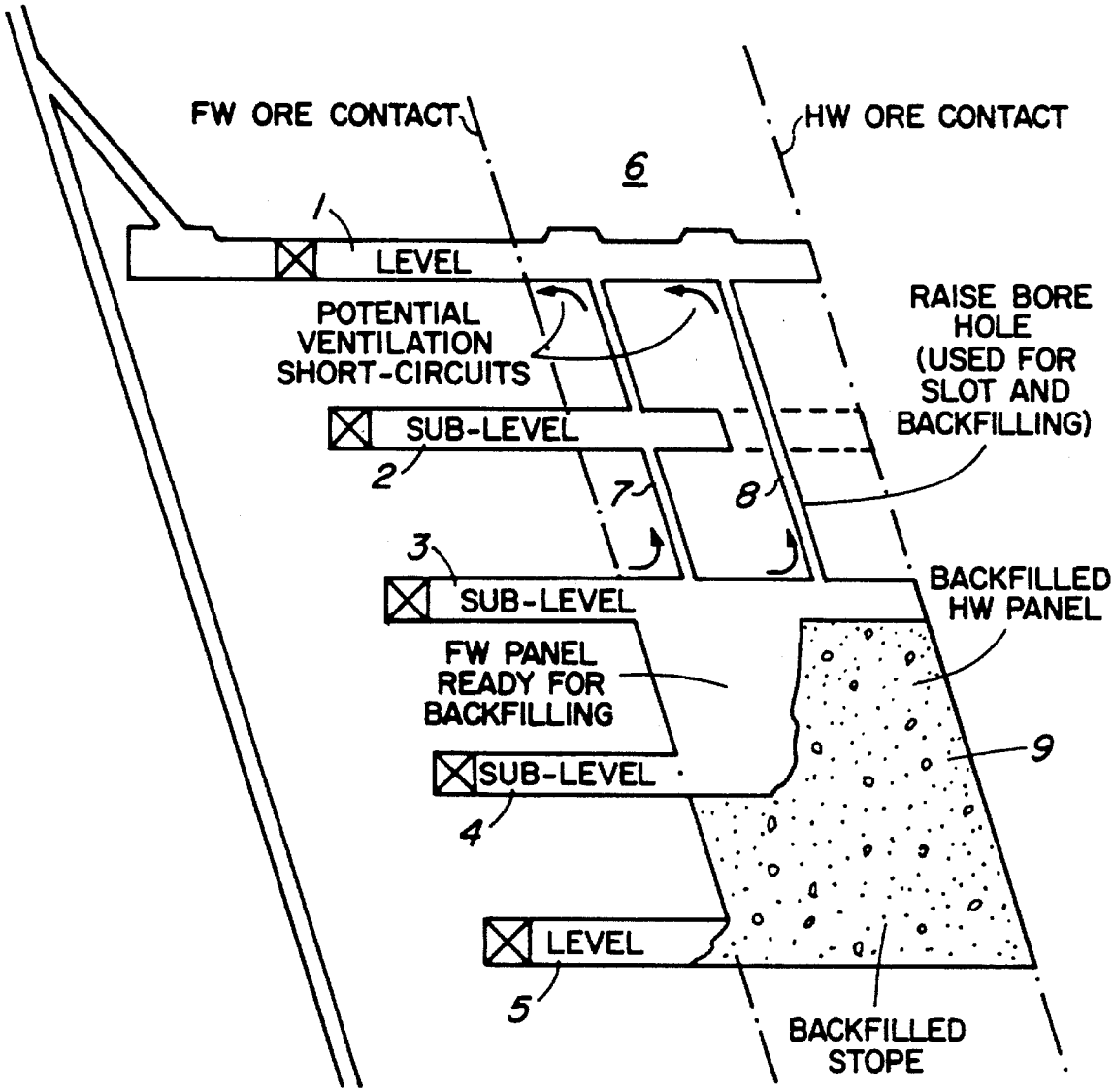
FIG. 1 is a schematic cross sectional view of a stope mine

FIG. 1 shows a cross section through a typical mine and shows a series of levels and sub-levels 1, 2, 3, 4 and 5. Ore is mined from the stope 6 above level 1 and passed through raise bore holes 7, 8 to sub-levels 2 or 3 from which it is removed to the surface. The stope, between levels 3 and 5 has been worked out and is, therefore, ready to receive waste rock and other backfill which is brought in via bore holes 7, 8.

Figure 2:
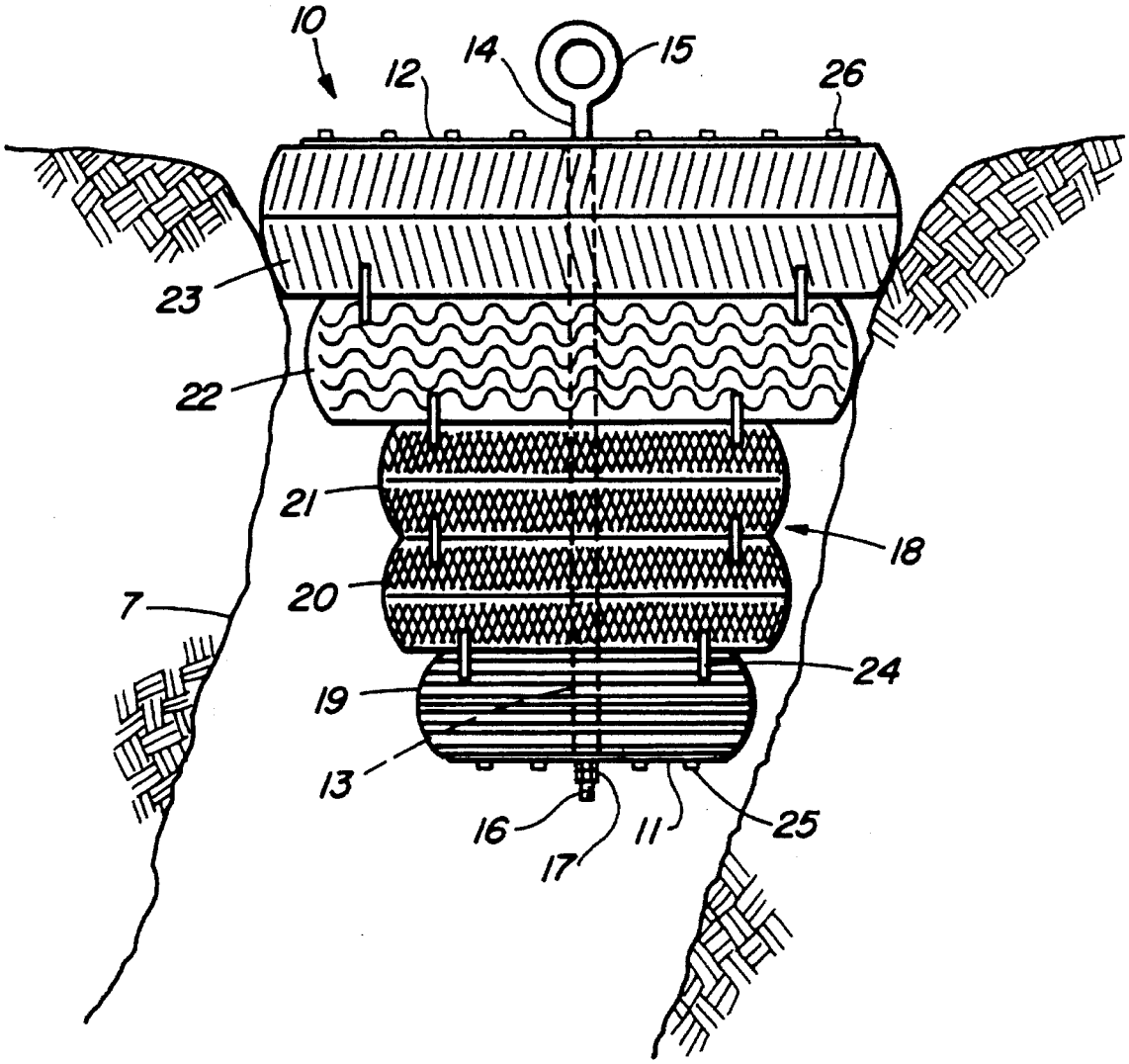
FIG. 2 is a cross sectional view of a borehole ventilation seal cover of the present invention.

It will be appreciated that bore holes 7, 8 provide considerable opportunity for short circuiting the air ventilation system along the various levels of the mine, if they are left open when ore or mucking operations are not in progress. As noted above closing of or at least reducing the air flow through the raise holes is not easy to accomplish. FIG. 2 shows raise bore hole 7 fitted with a seal cover 10, according to the present invention. Cover 10 comprises a lower circular metal plate 11, typically about 24" in diameter and ¼" thick, an upper circular metal plate 12, typically about 48" in diameter and ¼" thick separated from each other by a spacer pipe 13, typically 2" in diameter. A rod 14, having a ring 15 at the upper end and threaded at lower end 16 is passed coaxially through pipe 13 and bolted in place with nut 17. Coaxially mounted on pipe 13 in overlying planar relationship are a plurality of used vehicle tires 18, of varying diameter. The tires are arranged in increasing order of diameter from plate 11 to plate 12. Preferably, as shown in FIG. 2, five tires 19, 20, 21, 22 and 23 are provided, but of course this may be varied depending upon local conditions and the like. Thus tire 19 may be an old car tire, tires 20 and 21 may be light truck tires, tire 22 may be a heavy truck tire and tire 23 may be a tractor tire or the like, so that when assembled the device is roughly uniformly conical in section, The upper face of each tire (as seen in FIG. 2) is provided with a plurality of vertical pins 24, preferably about six spaced uniformly around an intermediate diameter thefor which is inserted into a respective mating hole in the lower surface of the abutting tire so as to hold each tire in fixed relation to its neighbour. Plates 11 and 12 are drilled around an intermediate diameter thereof and bolts 25, 26 etc, are screwed into the adjacent faces of the tires adjacent thereto so as to prevent rotation of plates during use. After assembly nut 17 is tightened to draw the tires into juxtaposition and form a unitary whole.

It will, of course, be appreciated that while FIG. 2 shows eye 15 adjacent the large end 10 of the device, this is merely a matter of choice and the rod 14 may be reversed so that eye 15 is adjacent the small end 11.

In use, in the configuration of FIG. 2, the device is lifted by a crane or other lifting device, such as a rope and pulley system or a hydraulic piston, over a bore hole 7 and then lowered into contact with the walls thereof, where it can be pressed into tight contact. If desired to seal the bore hole permanently, muck and/or concrete can be poured on top to form a permanent seal. In the event that it is desired to use the plug for temporarily sealing a mucking hole, the device may be used with the large end 10 down with the small end 11 and eye 15 uppermost. The plug is then pulled upwardly through the hole from the bottom until it engages with the walls. It is held in place by a rope/wire tackle system and a hydraulic cylinder (not shown). When it is desired to open the hole, the cylinder may be actuated to lower the plug into the bore hole and ore/muck can be passed around the lowered plug.

I claim:

1. A bore hole cover comprising: a plurality of hollow ring members of selected diameters having substantially parallel opposed sides arranged in overlying planar coaxial relationship in order of increasing diameter;

a pair of substantially rigid disc members arranged in planar spaced coaxial relationship on respective opposite sides of said coaxially arranged ring members;

a tubular spacer member mounted coaxially between said disc members; and rod means coaxially arranged in said tubular spacer member.

2. A bore hole cover as claimed in claim 1 wherein said ring members comprise vehicle tires.

3. A bore hole cover as claimed in claim 2 wherein said vehicle tires are selected from automobile tires, truck tires and tractor tires.

4. A bore hole cover as claimed in claim 1 wherein said rod means includes integrally formed lifting means at one longitudinal end thereof.

5. A bore hole cover as claimed in claim 4 wherein said rod means includes a threaded portion at a second longitudinal end thereof.

6. A bore hole cover as claimed in claim 1 including locating means between adjacent said ring means.

7. A bore hole cover as claimed in claim 6 wherein said locating means comprise a plurality of longitudinal pin means spaced around selected diameters in said ring means.

* * * * *